US006116896A

United States Patent [19]

Joshi et al.

[11] Patent Number: 6,116,896

[45] Date of Patent: Sep. 12, 2000

[54] SYSTEM AND METHOD FOR OXIDANT INJECTION IN ROTARY KILNS

[75] Inventors: Mahendra L. Joshi, Darien; Ovidiu Marin, Lisle; Olivier Charon, Chicago, all of Ill.; Jacques Dugue, Montigny le Bretonneux, France

[73] Assignees: Air Liquide America Inc., Walnut Creek, Calif.; L'Air Liquide, Societe Anonyme pour l'Etude Et, l'Exploitation des Procedes Georges Claude, Paris, France

[21] Appl. No.: 09/397,021

[22] Filed: Sep. 15, 1999

[51] Int. Cl.[7] ..... F27B 5/16

[52] U.S. Cl. ..... 432/117; 432/152; 432/201; 251/251

[58] Field of Search ..... 432/105, 113, 432/117, 145, 152, 201; 34/115; 110/226, 246, 347; 251/251, 263, 321

[56] References Cited

U.S. PATENT DOCUMENTS

| | | | |
|---|---|---|---|
| 3,397,256 | 8/1968 | Paul et al. . | |
| 3,945,624 | 3/1976 | Rossi | 266/20 |
| 4,354,829 | 10/1982 | Estes . | |
| 4,741,694 | 5/1988 | Mason et al. . | |
| 5,007,823 | 4/1991 | Mayotte et al. . | |
| 5,261,738 | 11/1993 | Brock | 432/117 |
| 5,431,560 | 7/1995 | Helker et al. | 432/105 |
| 5,549,058 | 8/1996 | Tutt | 110/226 |
| 5,572,938 | 11/1996 | Leger . | |
| 5,580,237 | 12/1996 | Leger . | |

OTHER PUBLICATIONS

Gaydas, R. A., "Oxygen enrichment of combustion air in rotary kilns," Journal of the PCA R & D Laboratories, 49–55 (Sep. 1965).

Wrampe, P. and Rolseth, H.C., "The effect of oxygen upon the rotary kiln's production and fuel efficiency: theory and practice", IEEE Trans. Ind. Appl., 568–573 (Nov. 1976).

*Primary Examiner*—Denise L. Ferensic
*Assistant Examiner*—Gregory A. Wilson
*Attorney, Agent, or Firm*—Burns, Doane, Swecker & Mathis LLP

[57] ABSTRACT

A system and method for increasing the amount of oxygen in a kiln chamber is disclosed. The radial surface of a rotatable kiln is provided with at least one oxidant injection port extending through the radial surface into the kiln chamber. A cam is connected to the radial surface adjacent the oxidant injection port. A valve assembly including a valve chamber in fluid communication with an oxidant supply is mounted adjacent the kiln substantially in fixed spatial relation with the rotatable kiln body. The valve assembly includes a follower member adapted to contact a surface to the cam to actuate the valve assembly. Rotation of the kiln body brings the cam into contact with the follower member, thereby actuating the oxidant injection assembly, and injecting oxidant through the injection port into the kiln chamber.

17 Claims, 5 Drawing Sheets

SYSTEM AND METHOD FOR OXIDANT INJECTION IN ROTARY KILNS

BACKGROUND OF THE INVENTION

1. Field of the Invention

The present invention relates to novel apparatus and processes for the injection of an oxidant into a rotary kiln. More particularly, the present invention relates to apparatus and processes which significantly improve combustion in a rotary kiln used for the calcination of minerals such as cement, lime, dolomite, magnesia, titanium dioxide, and other calcined materials.

2. Brief Description of the Related Art

The introduction of oxygen into a combustion space, e.g., a furnace, is used in a variety of industries for enhancement of the combustion process. The general use of oxygen in cement rotary kilns has been shown to lead to a significant production increase of the kiln, starting with the work of Gaydas, R. A., "Oxygen enrichment of combustion air in rotary kilns," Journal of the PCA R & D Laboratories, 49–66 (September 1965) (incorporated by reference in its entirety herein). Gaydas presents test results from a period between 1960 and 1962. It is noted that Geissler suggested in 1903 that oxygen be used for clinker production. Experimental work was done in Germany in the 1940's, but results are not available.

To date, the use of oxygen in rotary kilns has been applied in three main ways, well documented in the literature: introducing oxygen into the primary air, i.e., into the main burner; the utilization of an oxy-fuel burner in addition to a standard air-fuel burner; and oxygen lancing into the rotary kiln, particularly in a region between the load and the flame, for improved flame characteristics. One of the more documented uses of oxygen in rotary kilns is described in Wrampe, P. and Rolseth, H. C., "The effect of oxygen upon the rotary kiln's production and fuel efficiency: theory and practice", IEEE Trans. Ind. App., 568–573 (November 1976) (incorporated by reference in its entirety herein), which indicates that production increases above 50% produce excessive temperatures in the kiln, but below this level, kiln operation takes place without major problems.

Each method of introducing oxygen into the cement plant has advantages, as well as disadvantages. The introduction of oxygen into the primary air limits the total amount of oxygen capable of being introduced into the kiln, as modern cement kilns utilize 5–10% of the total air used as primary air. Therefore, in order to introduce a meaningful amount of oxygen into the kiln, it is necessary to significantly increase the concentration of oxygen in the air-fuel stream. Increasing the oxygen concentration may lead to potential safety problems, since the fuel is in contact with the $O_2$ enriched air prior to its arrival into the kiln's combustion space, and therefore can burn too early, or explode.

The use of a separate oxy-burner represents a more involved solution to increase the thermal transfer to the load, which in general requires significant quantities of quality fuel, such as natural gas or oil, as well as important modifications in the kiln back wall. This method has been previously proposed, such as U.S. Pat. No. 3,397,256 (which is incorporated by reference in its entirety herein). The use of oxygen lances, although a more elegant solution, can locally increase the temperature of the combustion space, which can result in non-uniform heat transfer to the entire flow of clinkers moving through the kiln. Oxygen lances can produce hot spots in the refractory, which may damage the refractory. Further, the introduction of cold oxygen may limit the beneficial effect of oxygen on combustion by locally cooling the flame. The employment of oxygen lances has been proposed in U.S. Pat. No. 5,572,938, U.S. Pat. No. 5,007,823, U.S. Pat. No. 5,580,237, and U.S. Pat. No. 4,741,694, all of which are incorporated by reference in their entireties herein.

U.S. Pat. No. 4,354,829 ('829 patent) describes mixing air and oxygen in a separate pipe, and introducing it through the rotary kiln moving walls. This device suffers from a number of significant problems, including the difficulty of creating a leak-free plenum which rotates with the kiln and the difficulty of installing tubes into the kiln. Additionally, the procedure disclosed in the '829 patent suffers from certain inherent drawbacks. Injecting an oxygen-enriched air mixture of 23–25% oxygen injects a significant amount of nitrogen into the kiln. Nitrogen does not facilitate combustion, and thus represents an unproductive use of flue gas volume. Excessive nitrogen content may result in additional dust generation and may significantly increase the amount of nitrous oxide ($NO_x$) emissions. Also, the injection of cold ambient air may reduce the thermal efficiency of the kiln and may cause additional stresses in the rotary kiln which can damage its expensive structure from thermal shock.

It is an object of the present invention to provide a safe, yet efficient system and method of introducing oxygen into rotary kilns used, for example, in cement producing equipment, in a manner which will enhance flame characteristics and improve production without adversely affecting overall plant operation.

SUMMARY OF THE INVENTION

The present invention provides a system and method for injecting an oxidant into the kiln chamber of a rotatable kiln at longitudinal locations along the kiln's length, and at different radial positions along the surface, if desired. The present invention utilizes a cam-actuated valve assembly in fluid communication with an oxidant source to inject oxidant through the radial surface of the kiln into the kiln chamber. Preferably, the oxidant includes at least 90%, and more preferably at least about 99% oxygen.

In one aspect, the invention provides a rotary kiln adapted to inject an oxidant into the kiln chamber at one or more locations along a longitudinal axis of the kiln. The kiln comprises a kiln body rotatable about its longitudinal axis and having at least one oxidant injection port extending through a radial surface of the kiln body, a cam mounted on the radial surface of the kiln body adjacent the oxidant injection port, an oxidant supply system for providing pressurized oxidant, and a valve assembly. The valve assembly includes a valve body disposed substantially in a fixed spatial relationship with the rotatable kiln body and defining a valve chamber in fluid communication with the oxidant supply system, and a follower member positioned to contact a surface of the cam to actuate the valve assembly. Rotation of the kiln body causes the cam to contact the follower member, thereby actuating the valve assembly to inject oxidant through the oxidant injection ports into the kiln chamber.

In another aspect, the invention provides a valve assembly for injecting oxidant through an oxidant port in the radial surface of a rotatable kiln body, the radial surface having a cam mounted adjacent the oxidant injection port. The valve assembly comprises a valve body disposed substantially in fixed spatial relation with the rotatable kiln body and having walls defining a valve chamber. The valve assembly also comprises a valve member movable between a first position in which the valve is closed, and a second position in which the valve is open. Finally, the valve assembly comprises a follower member connected to the valve member and adapted to contact a surface of the cam to move the valve member between the first position and the second position.

In yet another aspect, the invention provides a process of injecting an oxidant through a radial surface of a rotary kiln in at least one location along the longitudinal axis of the kiln chamber. The process comprises the steps of forming at least one oxidant injection port in the radial surface of the rotary kiln, connecting a cam to the radial surface of the rotary kiln adjacent the oxidant injection port, mounting an oxidant injection valve assembly proximate the rotatable kiln, the valve assembly comprising a valve body disposed substantially in fixed spatial relation with the rotatable kiln body, the valve body having walls defining a valve chamber, a valve member movable between a first position, in which the valve is closed, and a second position, in which the valve is open, and a follower member connected to the valve member and adapted to contact a surface of the cam to move the valve member between the first position and the second position, providing pressurized oxidant to the valve chamber, and rotating the kiln to actuate the valve assembly.

According to a further aspect, the invention provides a process of operating a kiln, comprising the steps of: (a) providing a kiln including a kiln body rotatable about its longitudinal axis and having at least one oxidant injection port extending through a radial surface of the kiln body, a cam mounted on the radial surface of the kiln body adjacent the oxidant injection port, an oxidant supply system for providing pressurized oxidant, and a valve assembly including a valve body disposed substantially in a fixed spatial relationship with the rotatable kiln body and defining a valve chamber in fluid communication with the oxidant supply system, and a follower member positioned to contact a surface of the cam to actuate the valve assembly; and (b) rotating the kiln to cause the cam to contact the follower member, thereby actuating the valve assembly.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF PREFERRED EMBODIMENTS

Figure 1:
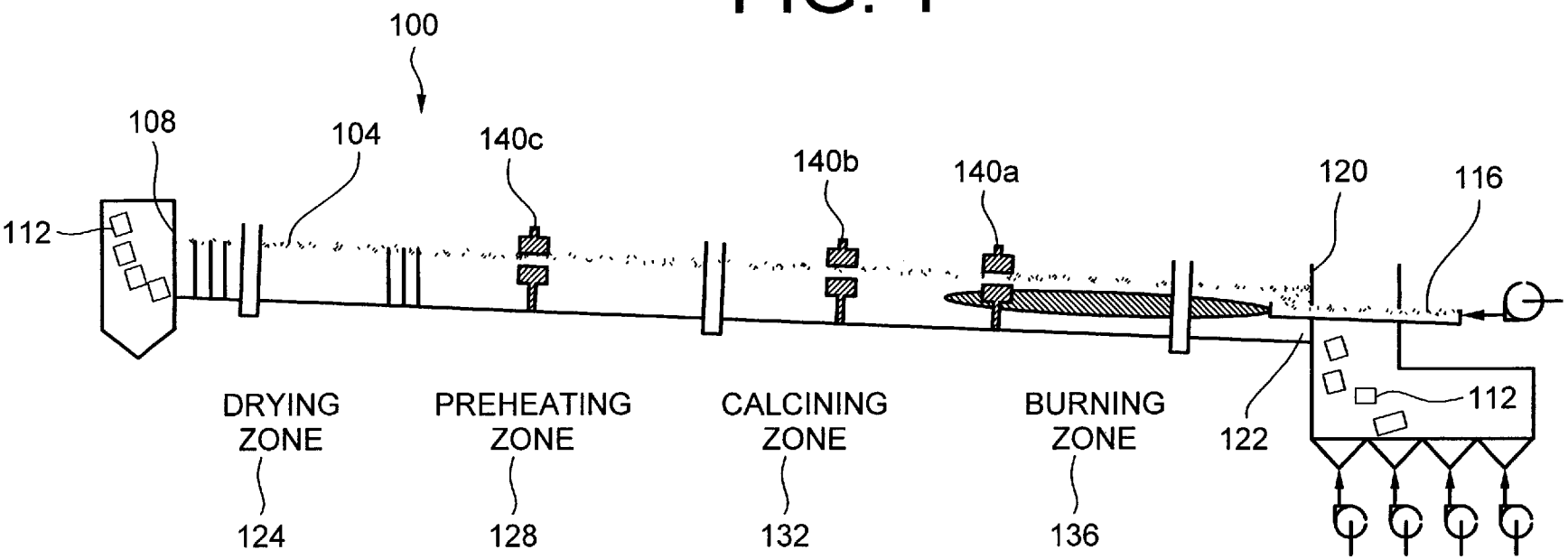
FIG. 1 is a schematic illustration of a rotary kiln in accordance with an embodiment of the present invention.

FIG. 1 is a schematic illustration of a rotary kiln in accordance with an embodiment of the present invention. Referring to FIG. 1, rotary kiln 100 includes a substantially cylindrical kiln body 104 rotatable about a longitudinal axis extending along its length. Kiln body 104 has an opening at a first end 108 for receiving raw material, commonly referred to in the art as raw "clinker" material 112, or "clinkers." The raw clinker material is conveyed along the floor of kiln body 104 and subjected to heat from burner 116 positioned proximate second end 120 of kiln body 104. Clinkers 112 are passed through an opening 122 in second end 120 of kiln body 104, whereupon they may be subjected to further treatment, if necessary.

It is common in the art to refer to kiln body 104 as having a plurality of zones. The zones may be designated as a drying zone 124 in which moisture is removed from raw clinker material 112, a preheating zone 128 in which the raw clinker material 112 is heated, typically to a temperature between 212 degrees Fahrenheit (100 degrees Celsius) and 575 degrees Fahrenheit (300 degrees Celsius). In calcining zone 132 and burning zone 136 the clinker material is exposed to temperatures in the range of 1190 degrees to 2630 degrees Fahrenheit (650 to 1450 degrees Celsius) to complete the clinker formation process. It will be appreciated that there is not a precise line of demarcation between the several zones.

In accordance with the present invention, kiln 100 includes a system for injecting an oxidant into the kiln body 104 to enrich the oxygen content of the air in kiln body 104. The term "oxidant", according to the present invention, means a gas with an oxygen molar concentration of at least 50%. Such oxidants include oxygen-enriched air containing at least 50% vol., oxygen such as "industrially" pure oxygen (99.5%) produced by a cryogenic air separation plant or non-pure oxygen produced by e.g. a vacuum swing adsorption process (about 88% vol. $O_2$ or more) or "impure" oxygen produced from air or any other source by filtration, adsorption, absorption, membrane separation, or the like, at either room temperature (about 25° C.) or in preheated form. Kiln 100 includes at least one oxidant injection location **140*a*, and preferably includes a plurality of oxidant injection locations 140*b*, 140*c* disposed at different points along its longitudinal axis. In one embodiment, kiln 100** may be adapted with three ports located at the 10 o'clock, 12 o'clock, and 2 o'clock positions.

In the embodiment depicted in FIG. 1, kiln 100 includes a first oxidant injection system **140*a* located at a first position in the vicinity of the main flame (e.g., in the burning zone) which may be used to tune the flame as desired. Introduction of a high purity oxidant (e.g., at least 90% oxygen) may improve the combustion process and limit emissions of $NO_x$ from the main flame. A second oxidant injection system 140*b* located in the calcining zone, near the middle of kiln body 104, which may be useful to enhance combustion, particularly in kilns that receive waste materials for combustion near the middle of the kiln. A third oxidant injection system 140*c* positioned near the first end 108 of kiln body 104 may be useful in reducing emissions of carbon monoxide (CO) from kiln 100. It will be appreciated that the number of oxidant injection systems and their respective locations along the longitudinal axis of kiln 100** may vary as a function of parameters including, but not limited to, the kiln length, the type of raw clinker material, the moisture content of the raw clinker material, the throughput rate of clinker material, and the type of fuel used within the scope of the present invention. Other potentially relevant parameters may include the type, quantity and mode of injection of waste to be incinerated in the kiln.

Figure 2:
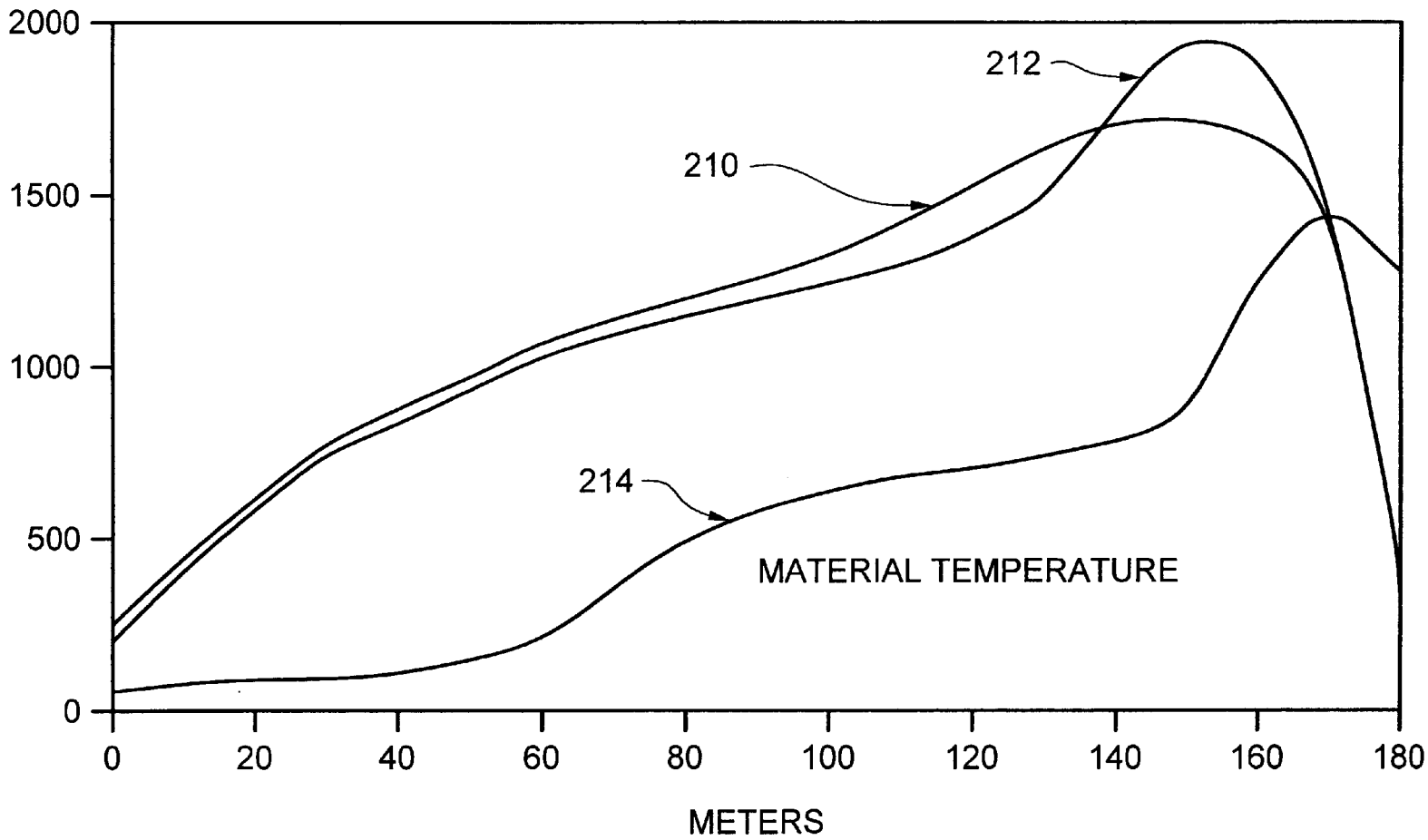
FIG. 2 is a graph plotting kiln gas temperatures and clinker material temperature against kiln length.

FIG. 2 is a graph plotting gas temperatures and clinker material temperature in degrees Celsius along against kiln length, measured from the clinker entrance along the kiln's longitudinal axis. Referring to FIG. 2, curve 210 represents a desired temperature profile for a kiln. The desired temperature profile 210 may be based on numerous parameters including, but not limited to, the kiln length, and the moisture content of the raw clinker material. Conventional oxygen injection techniques tend to result in a kiln temperature profile as illustrated by curve 212, and a clinker temperature profile as illustrated by curve 214, in which portions of the kiln near the main flame is heated above a desired temperature, and clinker material and portions of the kiln away from the main flame are cooler than a desired temperature. The addition of oxidant injection assemblies (e.g., 140*a*–140*c*) along the longitudinal extent of kiln body 104 allows a kiln operator to inject a desired amount of oxidant at desired locations to control the temperature profile of kiln along its longitudinal extent.

Figure 3:
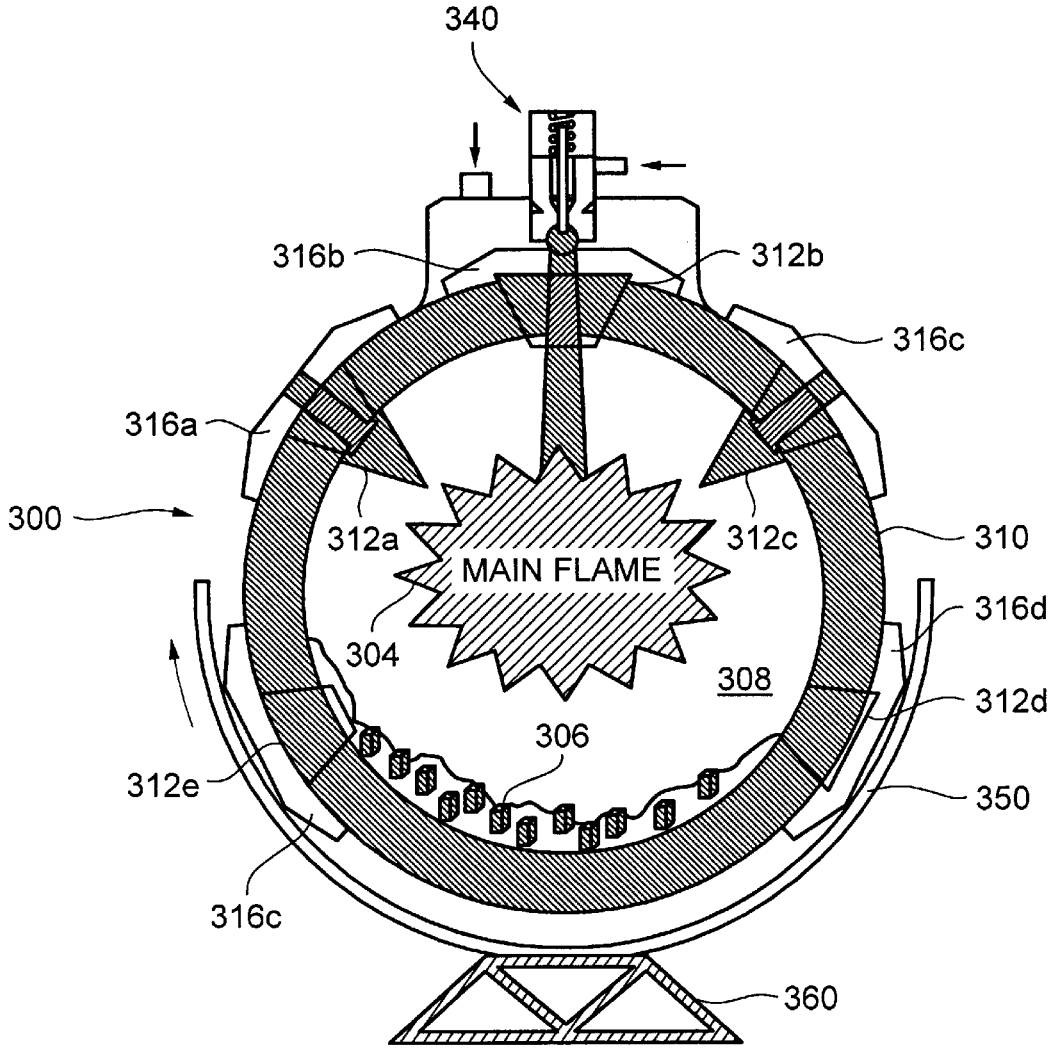
FIG. 3 is a cross-sectional, schematic illustration of an oxidant injection system in accordance with an embodiment of the present invention.

FIG. 3 is a cross-sectional, schematic illustration of a rotary kiln 300 adapted to include an oxidant injection system in accordance with an embodiment of the present invention. Referring to FIG. 3, kiln 300 includes a rotatable kiln body 310 having at least one injection port (e.g., 312*a*), at least one cam (e.g., 316*a*) disposed adjacent the injection port (e.g., 312*a*), and at least one oxidant injection valve assembly 340 in fluid communication with an oxidant source (not shown). In operation, rotation of kiln body 310 causes cam 316*a* to actuate valve assembly 340, which injects oxidant through injection port 312*a*. The various components of the system are explained in greater detail below.

Referring to FIG. 3, rotary kiln body 310 defines a kiln chamber 308 through which clinker material 306 flows and is subjected to heat from at least main flame 304. Kiln body 310 may be a conventional rotatable kiln body, which typically measures between 50 meters and 250 meters in length and is formed from a suitable metal or metal alloy, as will be readily apparent to one of ordinary skill in the art. Kiln body 310 includes at least one, and preferably a plurality of oxidant injection ports 312*a*, 312*b*, 312*c*, etc., defining an aperture extending through the radial surfaces of kiln body 310. The particular characteristics (e.g., shape, size, etc.) of injection ports 312*a*, 312*b*, 312*c*, etc. are not critical to the present invention. In general, injection ports 312*a*, 312*b*, 312*c*, etc. are holes or slots dimensioned to allow pressurized oxidant to flow into kiln chamber 308 to enhance combustion in chamber 308. Injection ports 312*a*, 312*b*, 312*c*, etc. may be formed in kiln body 310 using conventional metal forming processes including drilling, cutting, etc.

Figure 4:
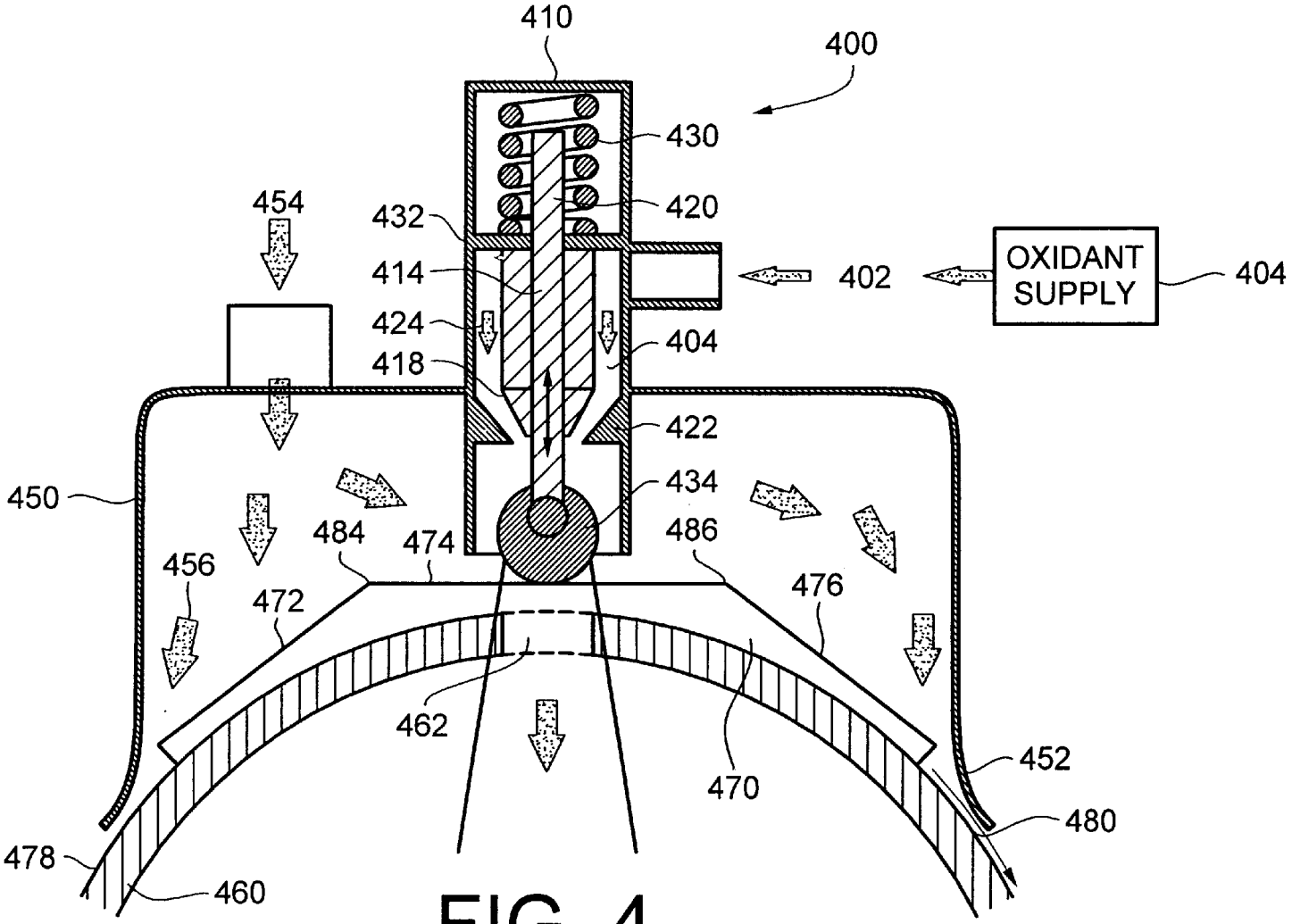
FIG. 4 is a cross-sectional, schematic illustration of a valve assembly in accordance with an embodiment of the present invention.

Kiln 300 further includes an oxidant injection valve assembly 340. FIG. 4 is a cross-sectional, schematic illustration of an valve assembly 400 in accordance with an embodiment of the present invention which can be used as valve assembly 340. Valve assembly 400 includes an oxidant source 404 that supplies oxidant to oxidant supply port 402, which is in fluid communication with a valve body 410 having walls defining a valve chamber 404. Valve body 410 houses a piston 414 mounted on shaft 420. Valve body 410 further includes a spring assembly 430 connected to shaft 420 at plate 432 through which the shaft extends, for biasing the shaft in a direction indicated by arrows 424, such that piston sealing surface 418 contacts housing sealing surface or valve seat 422 to close valve chamber 404, thereby preventing fluid flow through valve assembly 400.

A rotatable follower member 434 is connected to shaft 420. In a preferred embodiment, follower member 434 is embodied as a wheel rotatably mounted about an axle extending through shaft 420. However, the particular design of follower member 434 is not critical to the present invention. In alternate embodiments, follower member may be embodied as a rotatable ball mounted on an axle or in a suitable socket or as a low-friction sliding device.

Valve assembly 400 also preferably includes a hood 450 surrounding lower portions of valve assembly 400. A flexible curtain or skirt 452 depends from hood 450. Hood 450 and skirt 452 cooperate to inhibit foreign matter including rain, dust, and other particulate matter from contaminating valve assembly 400. Additionally, hood 450 may include a purge air inlet 454 which may be connected to a conventional pressurized air source (not shown) to provide air flow underneath hood 450, as indicated by arrows 456.

Valve assembly 400 is preferably positioned such that valve body 410 is disposed substantially in fixed spatial relation with rotatable kiln body 460 so that when the kiln body 460 rotates, the valve assembly 400 does not move with the kiln body and remains fixed. It will be appreciated that it may be desirable to allow slight relative movement between valve body 410 and rotatable kiln body 310 to absorb physical shocks, etc. However, valve body 410 should remain substantially fixed in relation to rotatable kiln body 460. Rotatable kiln body 460 includes an oxidant injection port 462 substantially as described in connection with FIG. 3 and a cam 470 disposed adjacent oxidant injection port 462. Cam 470 includes one or more contact surfaces (e.g., 472, 474, 476) for contacting follower member 434.

In operation, an oxidant source (illustrated) supplies pressurized oxidant to oxidant supply port 402. When follower member 434 is not in contact with a cam (e.g., cam 470) and is adjacent to circumferential portions 478, 480 of kiln body 460, spring assembly 430 biases shaft 420 such that piston sealing surface 418 contacts housing sealing surface 422 such that oxidant cannot pass from valve chamber 404. Rotation of kiln body 460 causes cam 470, including raised portions 472, 474, 476 of the cam, to contact follower member 434, moving shaft 420 in a direction opposite the bias provided by spring assembly 420. Upward movement of shaft 420 separates piston sealing surface 418 from housing sealing surface 422, thereby allowing pressurized oxidant to flow through valve chamber 404 and injection port 462 into the chamber defined by kiln body 460. Continued rotation of kiln body 460 causes cam 470 to lose contact with follower member 434, whereupon the force provided by spring assembly 430 biases shaft 420 in the direction indicated by arrows 424 to force piston sealing surface 418 against housing sealing surface 422 to close valve chamber 404, thereby preventing oxidant flow. As will be readily appreciated by one of ordinary skill in the art, shaft 420 and cam 470 can be sized and dimensioned so that oxidant flow is cut off prior to follower number 434 losing contact with the cam.

Figure 5:
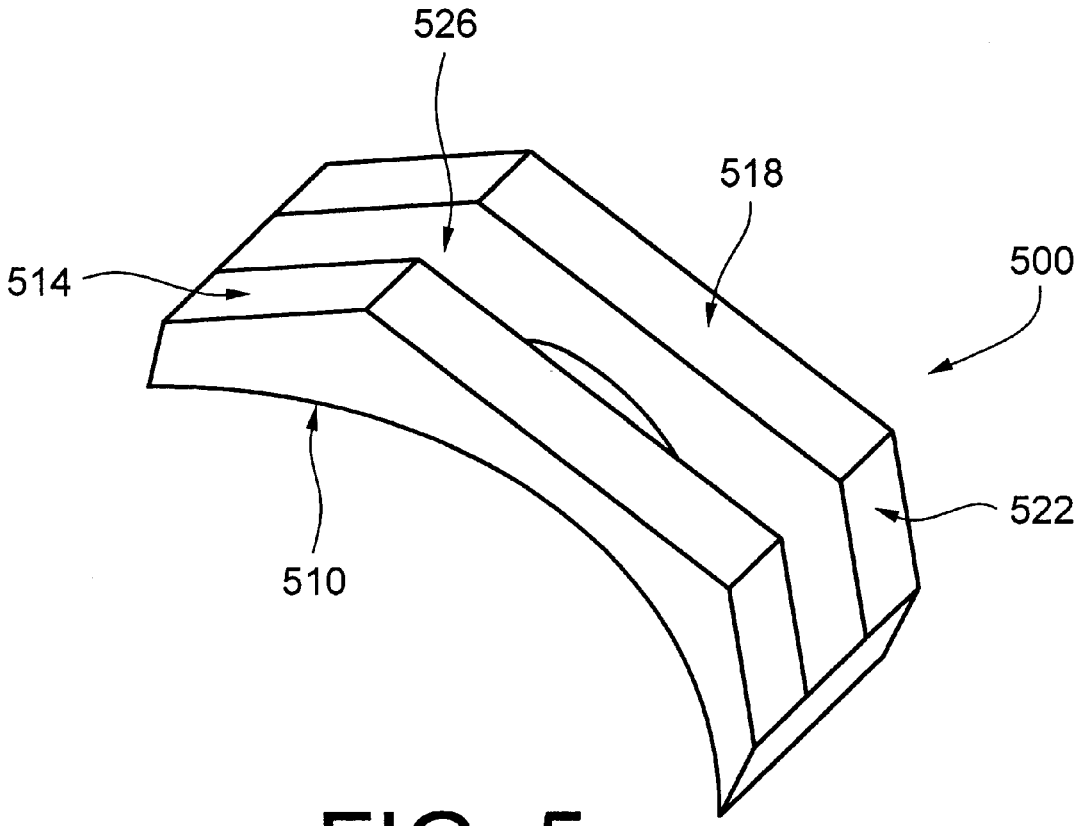
FIG. 5 is a perspective view of a cam in accordance with an embodiment of the present invention.

FIG. 5 provides a perspective view of a representative cam 500 suitable for use in the present invention as cam 470. Cam 500 includes an inner surface 510 adapted to be connected to the outside surface of kiln body 460. Cam 500 further includes an injection start surface 514, a high-injection rate surface 518, and an injection stop surface 522. Injection start surface 514 is adapted to effect a gradual opening of valve assembly to prevent an abrupt flow of oxidant through a valve assembly. Similarly, injection stop surface 522 is adapted to effect a gradual closing of a valve assembly to prevent an abrupt cut-off of oxidant flow. High-injection rate surface 518 is preferably adapted to effect a desired flow rate of oxidant into the kiln chamber. An oxidant injection slot 526 is formed in cam 500 to allow oxidant to pass through cam 500. Preferably, oxidant injection slot 526 is dimensioned to correspond with the oxidant injection port (e.g., 462) adjacent to which cam 500 is connected. Cam 500 may be formed from any suitably durable, rigid material including metals or metal alloys, polymers, ceramics, or composite materials.

Referring again to FIG. 3, rotatable kiln body 310 includes five oxidant injection ports 312*a*–312*e* coupled with five cams 316*a*–316*e* at the position of the longitudinal cross-section taken in FIG. 3. Thus, each rotation of kiln body 310 results in five oxidant injections by oxidant valve assembly 340. It will be appreciated that multiple oxidant injection assemblies 340 could be added to kiln 300 such that oxidant may be injected from multiple locations at each longitudinal cross section.

In the embodiment depicted in FIG. 3, kiln 300 further includes a retainer member 350 disposed proximate the lower portions of kiln body 310 to reduce the amount of raw clinker material 306 allowed to spill from kiln chamber 308. Retainer member 350 may be embodied as a substantially U-shaped channel that is substantially fixedly retained adjacent to lower portions of kiln body 310. Retainer member 350 is positioned and adapted to fit in oxidant injection slot 526 in cam 500 to inhibit clinker material 306 from passing through oxidant injection ports 312*a*–312*e* when the rotation of kiln body 310 causes them to be at the 'bottom' of kiln body 310. Retainer member 350 may optionally also be filled with a rubber pad or brush-type material to enhance the seal between the injection ports 312*a*–312*e* and the retainer member. Retainer member 350 is depicted as a substantially semi-circular member, extending through an angle of approximately 180°. It will be appreciated that retainer member 350 may extend through an angle greater or lesser than 180° to accommodate more or less clinker material 306, respectively. Additionally, it will be appreciated that oxidant injection ports 312*a*–312*e* may include one-way valves (not illustrated) that inhibit the flow of clinker material through injection ports 312*a*–312*e* when kiln body 310 rotates, but which permit oxidant flow into the kiln chamber 308. Retainer member 350 may be supported by a suitable ground support 360.

The oxidant supply system for providing pressurized oxidant to the respective oxidant injection systems may comprise a conventional train having a flow strainer, double block and double bleed-type safety valves, low and high pressure switches, flow meters, and automatic flow control valves connected to a programmable logic circuit (PLC) or a personal computer (PC). The system may further include pressure and flow indicators and check valves for unidirectional flow. Preferably, the oxidant supply system can provide oxidant at a rate that ranges between 2,000 standard cubic feet per hour (scfh) (0.0146 $Nm^3$/sec) and 200,000 scfh (1.46 $Nm^3$/sec). It will be appreciated that each oxidant injection assembly may have its own flow metering and flow bias valve system so that a desired amount of oxidant can be injected into the kiln at each injection assembly.

While the invention has been discussed in the context of particular embodiments described above, numerous alternate embodiments will be readily apparent to one of ordinary skill in the art. By way of example, in the embodiment depicted in FIG. 4, piston sealing surface 418 and housing sealing surface 422 were depicted as having a substantially frusto-conical cross-section. It will be appreciated that piston sealing surface 418 and housing sealing surface 422 may be flat, curved, or of any other shape that effects a seal. Additionally, while the embodiment depicted in FIG. 4 uses spring assembly 430 to bias piston 414 such that valve chamber 404 is closed, it will be appreciated that the particular biasing mechanism is not critical to the invention and numerous other biasing mechanisms could be used. By way of example, piston 414 could be provided with a ring seal(s) such that the pressure of oxidant supply 402 biases piston to close valve chamber 404. Also, it will be appreciated that the shape and size of the cams may be modified as desired. By way of example, the cams may have differently contoured surfaces (e.g., smooth, multi-sided) and may be of different sizes.

The present invention provides a number of advantages over conventional kilns and over conventional oxidant injection techniques. The present invention provides a safe, reliable, relatively inexpensive system and method for injecting oxidant at one or more desired locations along the longitudinal axis of a rotary kiln. The system requires a relatively small number of moving parts and seals, which enhances its reliability, while reducing its cost. The present invention also enables a variable amount of oxidant to be injected into the kiln. First, the valve assembly and cam cooperate to determine the timing and amount of oxidant injected by each valve assembly. Thus, the amount of oxidant injected by each valve assembly may be adjusted by altering the cam shape, the relative positions of the valve assembly and the rotatable kiln body, or both. A system according to the present invention is also readily scalable—the amount of oxidant injected at a particular point on the longitudinal axis of the kiln may be scaled up or down by adding additional oxidant injection assemblies as required. Further, the present invention allows a kiln operator to alter the amount of oxygen in the kiln chamber to achieve a desired flame profile (or temperature profile) along the kiln length. A suitable temperature measurement and control system may be connected to the oxidant supply system of the present invention to adjust the amount of oxidant injected into the kiln body to achieve a desired temperature profile. Finally, by increasing the oxygen content at desired locations along the longitudinal axis of the kiln, suitable use of the present invention should result in lower $NO_x$ emissions and lower CO emissions.

What is claimed is:

1. A rotary kiln adapted to inject an oxidant into the kiln chamber at one or more locations along a longitudinal axis of the kiln, comprising:

a kiln body rotatable about its longitudinal axis and having at least one oxidant injection port extending through a radial surface of the kiln body;

a cam mounted on the radial outer surface of the kiln body adjacent the oxidant injection port;

an oxidant supply system for providing pressurized oxidant; and a valve assembly including:

a valve body disposed substantially in a fixed spatial relationship with the rotatable kiln body and defining a valve chamber in fluid communication with the oxidant supply system, and a follower member positioned to contact a surface of the cam to actuate the valve assembly.

2. A rotary kiln according to claim 1, wherein the valve assembly further includes:

a valve member connected to the follower member and moveable between a first position, in which the valve is closed, to a second position, in which the valve is open.

3. A rotary kiln according to claim 1, wherein:

said cam member and said follower member are positioned relative to each other so that rotation of the kiln body brings the cam member into contact with the follower member, thereby actuating the valve assembly.

4. A rotary kiln according to claim 1, further comprising:

a retainer member disposed adjacent lower portions of the kiln body and including portions which block the oxidant injection ports to inhibit the spilling of clinker material from the kiln body.

5. A rotary kiln according to claim 1, wherein the kiln body comprises:

an opening at a first end for receiving raw clinker material and an opening at a second end for releasing treated clinker material; and a burner disposed proximate the second end, and wherein the cam and the valve assembly are located proximate the burner, such that oxidant may be injected to enhance combustion near the burner in the kiln.

6. A rotary kiln according to claim 1, wherein:

the kiln body includes an opening at a first end for receiving raw clinker material and the cam and the valve assembly are located proximate the opening at the first end of the kiln, such that oxidant may be injected to enhance combustion of flue gases passing through the opening at the first end of the kiln.

7. A rotary kiln according to claim 1, wherein:

the cam and the valve assembly are located proximate middle portions of the kiln.

8. A rotary kiln according to claim 1, further comprising:

a purge air inlet for injecting a suitable purge gas into a region surrounding the valve assembly.

9. A valve assembly for injecting oxidant through an oxidant port in the radial surface of a rotatable kiln body, the radial surface having a cam mounted adjacent the oxidant injection port, comprising:

a valve body disposed substantially in fixed spatial relation with the rotatable kiln body and having walls defining a valve chamber;

a valve member movable between a first position, in which the valve is closed, and a second position, in which the valve is open; and a follower member connected to the valve member and adapted to contact a surface of the cam to move the valve member between the first position and the second position.

10. A valve assembly according to claim 9, further comprising:

an oxidant supply in fluid communication with the valve chamber.

11. A valve assembly according to claim 9, further comprising:

means for biasing the valve member into the first position.

12. A valve assembly according to claim 9, wherein:

the valve member comprises a piston mounted on a shaft and having a sealing surface on a first end; and the means for biasing the valve member comprises a spring connected to the shaft to bias the sealing surface against the valve seat.

13. A valve assembly according to claim 9, wherein:

the follower member is rotatably mounted to the shaft and positioned to contact a surface of the cam to move the valve member from the first position to the second position.

14. A valve assembly according to claim 9, wherein:

the valve member comprises a piston mounted on a shaft and having a sealing surface on a first end; and the means for biasing the valve member comprises a seal ring depending from a radial surface of the piston, whereby pressure from the oxidant supply biases the sealing surface against a valve stop surface.

15. A valve assembly according to claim 9, wherein the oxidant supply comprises:

an oxidant source; and a flow control system for supplying oxidant at a desired pressure between 20 psig (1.4 bar) and 100 psig (6.9 bar) and at a desired flow rate between 2000 scfh (0.0146 $Nm^3$/sec) and 200,000 scfh (1.46 $Nm^3$/sec).

16. A process of injecting an oxidant through a radial surface of a rotary kiln in at least one location along the longitudinal axis of the kiln chamber, comprising the steps of:

forming at least one oxidant injection port in the radial surface of the rotary kiln;

connecting a cam to the radial surface of the rotary kiln adjacent the oxidant injection port;

mounting an oxidant injection valve assembly proximate the rotatable kiln, the valve assembly comprising a valve body disposed substantially in fixed spatial relation with the rotatable kiln, the valve body having walls defining a valve chamber, a valve member movable between a first position, in which the valve is closed, and a second position, in which the valve is open, and a follower member connected to the valve member and adapted to contact a surface of the cam to move the valve member between the first position and the second position;

providing pressurized oxidant to the valve chamber; and rotating the kiln to actuate the valve assembly.

17. A process of operating a kiln, comprising the steps of:

providing a kiln including:

a kiln body rotatable about its longitudinal axis and having at least one oxidant injection port extending through a radial surface of the kiln body into the interior of said kiln body;

a burner positioned adjacent an end of said kiln body;

a cam mounted on the radial surface of the kiln body adjacent the oxidant injection port;

an oxidant supply system for providing pressurized oxidant; and a valve assembly including:

a valve body disposed substantially in a fixed spatial relationship with the rotatable kiln body and defining a valve chamber in fluid communication with the oxidant supply system, and a follower member positioned to contact a surface of the cam to actuate the valve assembly; and generating said burner to heat portions of said kiln body interior;

rotating the kiln to cause the cam to contact the follower member, thereby actuating the valve assembly to admit oxidant into said kiln body interior.

* * * * *